US005622367A

United States Patent [19]

Hwang

[11] Patent Number: 5,622,367

[45] Date of Patent: Apr. 22, 1997

[54] BINGO GAME MACHINE

[76] Inventor: Chyi-Sheng Hwang, No. 18, Lane 47, Sec. 2, Tsu Chiang Rd., Sanchung City, Taipei Hsien, Taiwan

[21] Appl. No.: 547,726

[22] Filed: Oct. 20, 1995

[51] Int. Cl.[6] ..... A63F 3/06

[52] U.S. Cl. ..... 273/144 A; 273/144 B

[58] Field of Search ..... 273/269, 270, 273/139, 144 R, 144 A, 144 B

[56] References Cited

U.S. PATENT DOCUMENTS

| | | | |
|---|---|---|---|
| 1,562,197 | 11/1925 | Andrew | 273/144 A |
| 3,044,780 | 7/1962 | Silverman | 273/144 A |
| 4,205,465 | 6/1980 | Mannarino | 273/144 A X |
| 4,895,370 | 1/1990 | Kline | 273/144 B |
| 5,011,157 | 4/1991 | Lovell et al. | 273/144 R X |
| 5,050,882 | 9/1991 | Yang | 273/144 B |
| 5,328,173 | 7/1994 | Stern | 273/144 B |
| 5,348,480 | 9/1994 | Vickerman | 273/144 B X |
| 5,427,374 | 6/1995 | Ulloa et al. | 273/144 B |

FOREIGN PATENT DOCUMENTS

| | | | |
|---|---|---|---|
| 2399701 | 4/1979 | France | 273/144 B |
| 3619997 | 12/1987 | Germany | 273/144 B |

*Primary Examiner*—William E. Stoll

[57] ABSTRACT

A bingo game machine including a ball chamber having a top cover and rows of ball holes on the top cover, a blower controlled to blow balls out of the ball chamber to the ball holes through a ball outlet conduit, a sliding plate reciprocated by a reciprocating mechanism to close or open the ball holes of the top cover, a plurality of electric eyes to detect the presence of a ball in each ball hole of the top cover of the ball chamber for payoff counting, a micro switch mounted on the ball outlet conduit for counting the number of balls passing from the ball chamber into the ball outlet conduit, an electromagnetic valve driven to control the passage of the ball outlet conduit, and a control circuit for controlling the operation of the blower, the reciprocating mechanism, the electric eyes, the micro switch, and the electromagnetic valve.

1 Claim, 5 Drawing Sheets

BINGO GAME MACHINE

BACKGROUND AND SUMMARY OF THE INVENTION

The present invention relates to bingo game machines, and relates more particularly to such a bingo game machine which is operated to automatically put balls into different ball holes and then to automatically count the payoff rate.

There is known a bingo game machine which comprises a ball chamber, which holds a plurality of hollow, light balls that are marked with a respective marking, and a blower controlled to blow the balls out of the ball chamber for putting in corresponding ball holes on the top of the ball chamber. The payoff rate is determined subject to the combination of the balls which are driven out of the ball chambers and put in the ball holes.

The present invention provides a bingo game machine which is operated to automatically blow balls out of the ball chamber to the ball holes on the top cover of the ball chamber, and to automatically count the payoff rate. According to the preferred embodiment of the present invention, the bingo game machine comprises a ball chamber having a top cover and rows of ball holes on the top cover, a blower controlled to blow balls out of the ball chamber to the ball holes through a ball outlet conduit, a sliding plate reciprocated by a reciprocating mechanism to close or open the ball holes of the top cover, a plurality of electric eyes to detect the presence of a ball in each ball hole of the top cover of the ball chamber for payoff counting, a micro switch mounted on the ball outlet conduit for counting the number of balls passing from the ball chamber into the ball outlet conduit, an electromagnetic valve driven to control the passage of the ball outlet conduit, and a control circuit for controlling the operation of the blower, the reciproccating mechanism, the electric eyes, the micro switch, and the electromagnetic valve.

DETAILED DESCRIPTION OF THE PREFERRED EMBODIMENT

Figure 1:
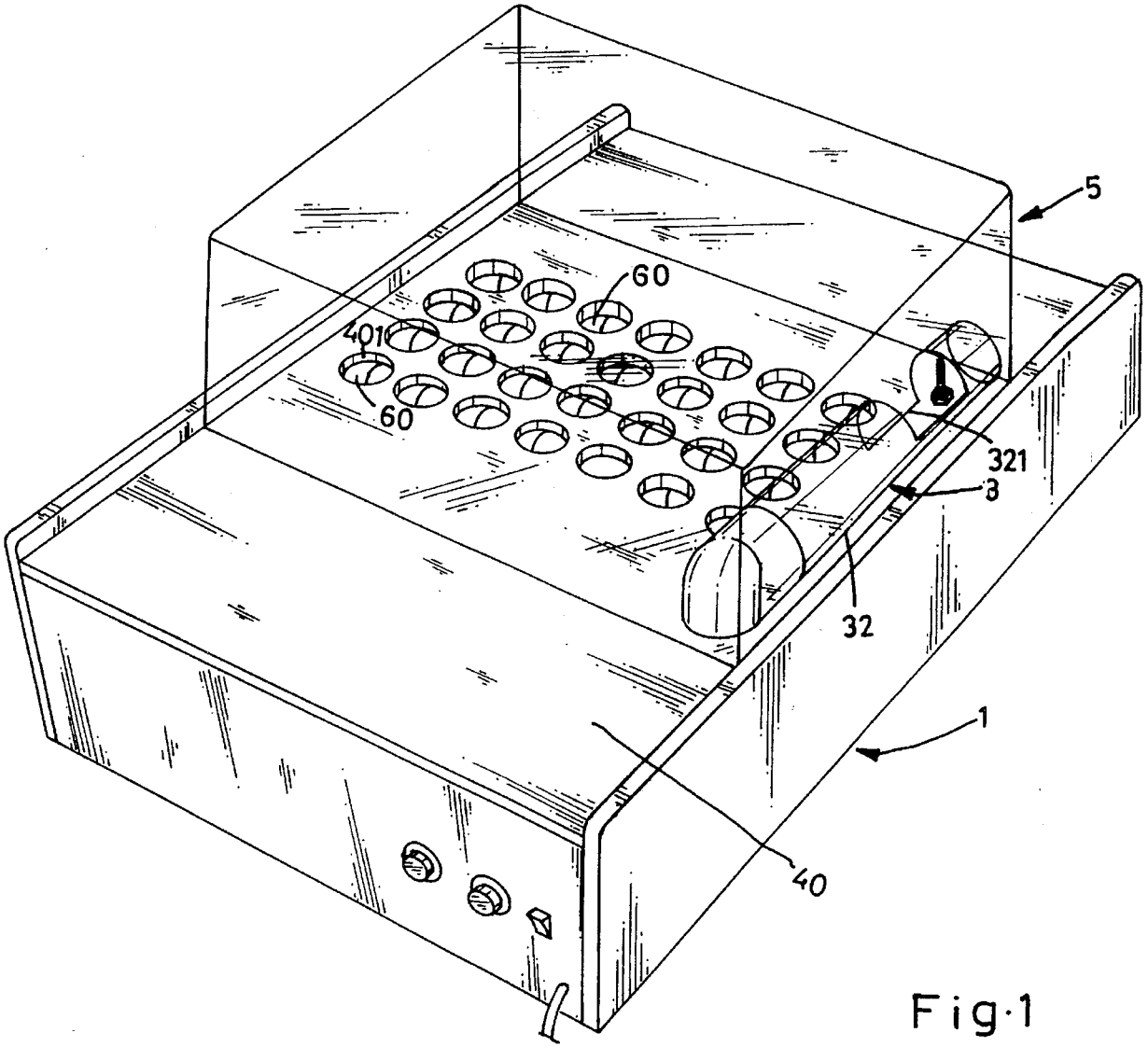
FIG. 1 is an elevational view of a bingo game machine according to the present invention.
Figure 2:
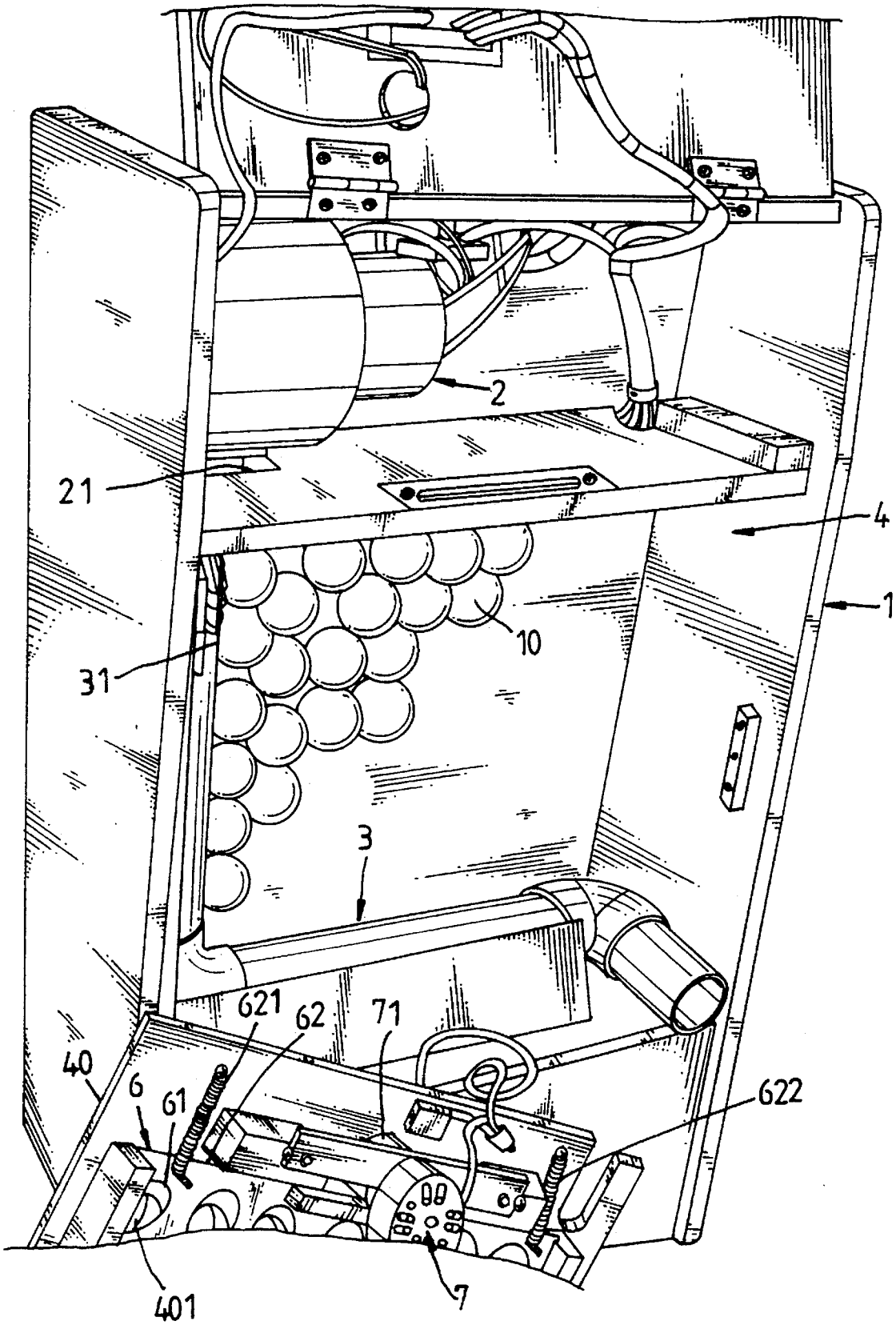
FIG. 2 shows the internal arrangement of the mainframe of the bingo game machine according to the present invention.

Referring to FIGS. 1 to 5, a bingo game machine is generally comprised of a housing 1, a blower 2, a ball outlet conduit 3, a ball chamber 4 inside the housing 1, a plurality of specifically marked balls 10 put in the ball chamber 4, a transparent covering 5, a sliding plate 6, a motor 7, a control circuit (not shown), an electromagnetic valve 8, a micro switch 9, and a plurality of electric eyes (not shown). The balls 10 are preferably of hollow, plastic bails,for example, ping-pong balls, that can be blown into the air by the blower 2. The blower 2 is mounted inside the housing 1 and controlled by the control circuit, having an air outlet 21 connected to the inside of the ball chamber 4 and spaced from the ball inlet 31 of the ball outlet conduit 3 at a distance not shorter than the diameter of the ball 10 (see FIG. 3). When the blower 2 is operated by the control circuit to blow air into the ball chamber 4, the balls 10 are forced to bounce in different directions, causing one ball 10 to enter the ball inlet 31 of the ball outlet conduit 3. The ball outlet conduit 3 has a ball inlet 31 at one end inserted into the ball chamber 4 and spaced from the air outlet 21 of the blower 2, and a ball outlet pipe 32 extended out of the top cover 40 of the ball chamber 4 and suspended inthe transparent covering 5. The ball outlet pipe 32 has a ball outlet 321 through which the balls 10 are forced out of the ball outlet conduit 3 into the inside of the transparent covering 5. The ball chamber 4 comprises rows of ball holes 401 through the top cover 40, and two sliding grooves 402 bilaterally disposed at the bottom side for the sliding of the sliding plate 6 (see FIG. 4). Each ball hole 401 of the top cover 40 of the ball chamber 4 is marked with a respective mark, for example, a respective number. The motor 7 is mounted on the top cover 40 of the ball chamber 4 at the bottom, having a cam 71 coupled to the output shaft (not shown) thereof. The sliding plate 6 is stopped against the cam 71 of the motor 7. The transparent covering 5 covers on the top side of the top cover 40 of the ball chamber 4. The sliding plate 6 is reciprocated in the sliding grooves 402 of the ball chamber 4, having toys of ball holes 61 corresponding to the ball holes 401 of the top cover 40 of the ball chamber 4, and one side 62 connected to the top cover 40 of the ball chamber 4 by springs 621 and 622 and stopped against the periphery of the cam 71. When the motor 7 is started, the cam 71 is rotated to reciprocate the sliding plate 6 (see FIGS. 4 and 5). When the sliding plate 6 is moved forwards, the ball holes 61 of the sloding plate 6 are respectively aligned with the ball holes 401 of the top cover 40 of the ball chamber 4 (see FIG. 4) for letting the balls 10, which are put in the ball holes 401 of the top cover of the ball chamber 4, pass from the ball holes 401 of the top cover 40 of the ball chamber 4 through the ball holes 61 of the sliding plate 6 into the ball chamber 4. When the sliding plate 6 is moved backwards, the ball holes 61 of the sliding plate 6 are not in alignment with the ball holes 401 of the top cover 40 of the ball chamber 4 (see FIG. 5), and therefore the balls 10 which are put in the ball holes 401 of the top cover 40 are stopped in place by the sliding plate 6. The aforesaid electric eyes are respectively mounted between the top cover 40 of the ball chamber 4 and the sliding plate 6 to detect the presence of a ball 10 in each ball hole 401 of the top cover 40, and to give a respective signal to the control circuit upon the presence of a ball 10 in the respective ball hole 401. The micro switch 9 is mounted on the ball outlet conduit 3 near the ball inlet 31. When one ball 10 is forced into the ball inlet 31 of the ball outlet conduit 3, the micro switch 9 is triggered to give a signal to the control circuit. Therefore, the control circuit can accurately control the number of balls 10 into the ball outlet conduit 3. The electromagnetic valve 8 is mounted inside the ball chamber 4, and controlled by the control circuit to reciprocate a valve rod 81. When the valve rod 81 is moved forwards, the balls 10 in the ball chamber 4 are stopped from entering the ball outlet conduit 3; when the valve rod 81 is moved backwards, the ball inlet 31 of the ball outlet conduit 3 is opened, and therefore the balls 10 in the ball chamber 4 can be forced the ball inlet 31 of the ball outlet conduit 3 (see FIG. 3).

Figure 3:
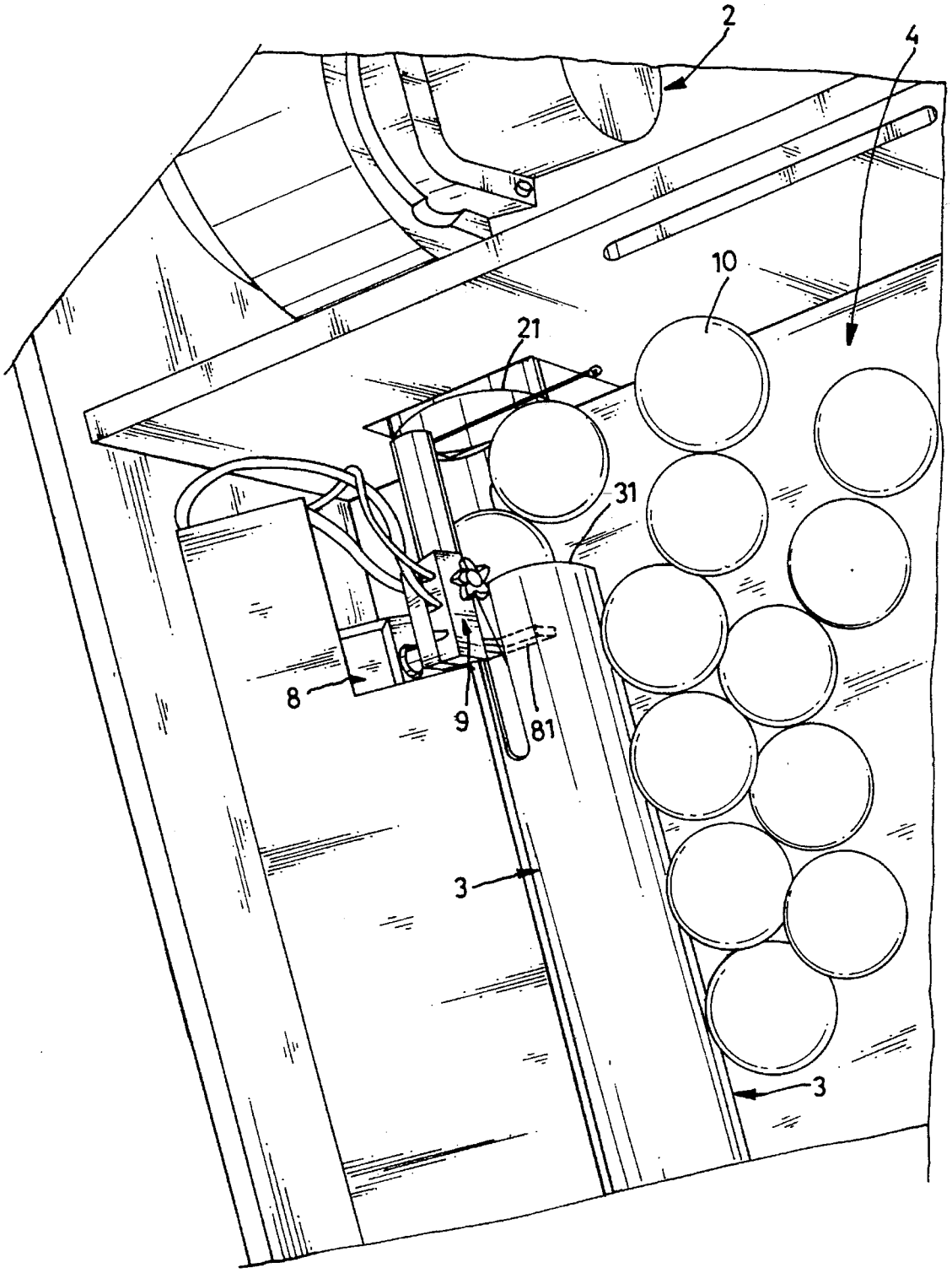
FIG. 3 is a partial view of the ball chamber in an enlarged scale, showing the position of the ball outlet conduit relative to the air outlet of the blower, and the position of the electromagnetic valve relative to the ball outlet conduit.
Figure 4:
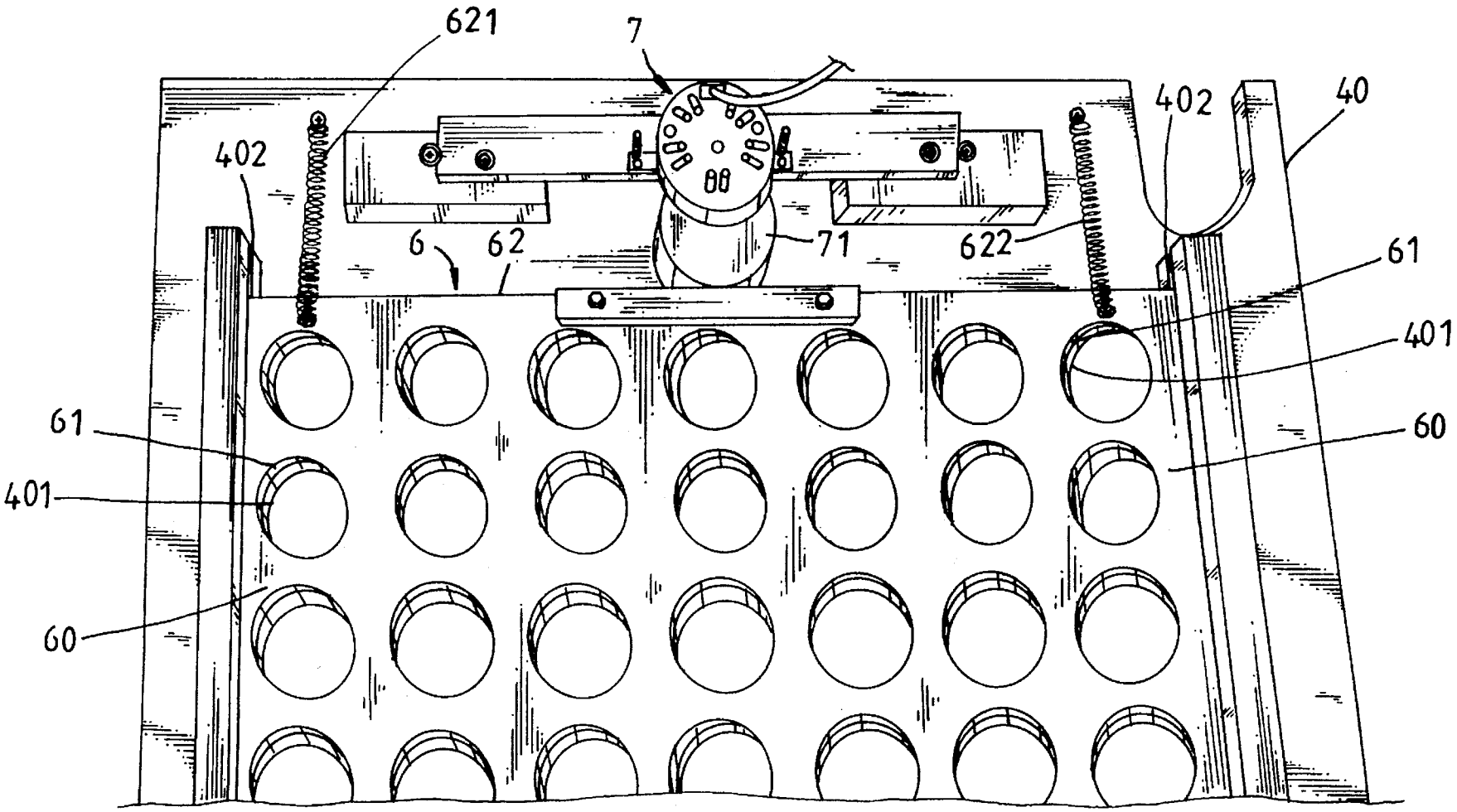
FIG. 4 is a bottom view of the sliding plate and the top cover of the ball chamber, showing the ball holes of the sliding plate respectively aligned with the ball holes of the top cover of the ball chamber.
Figure 5:
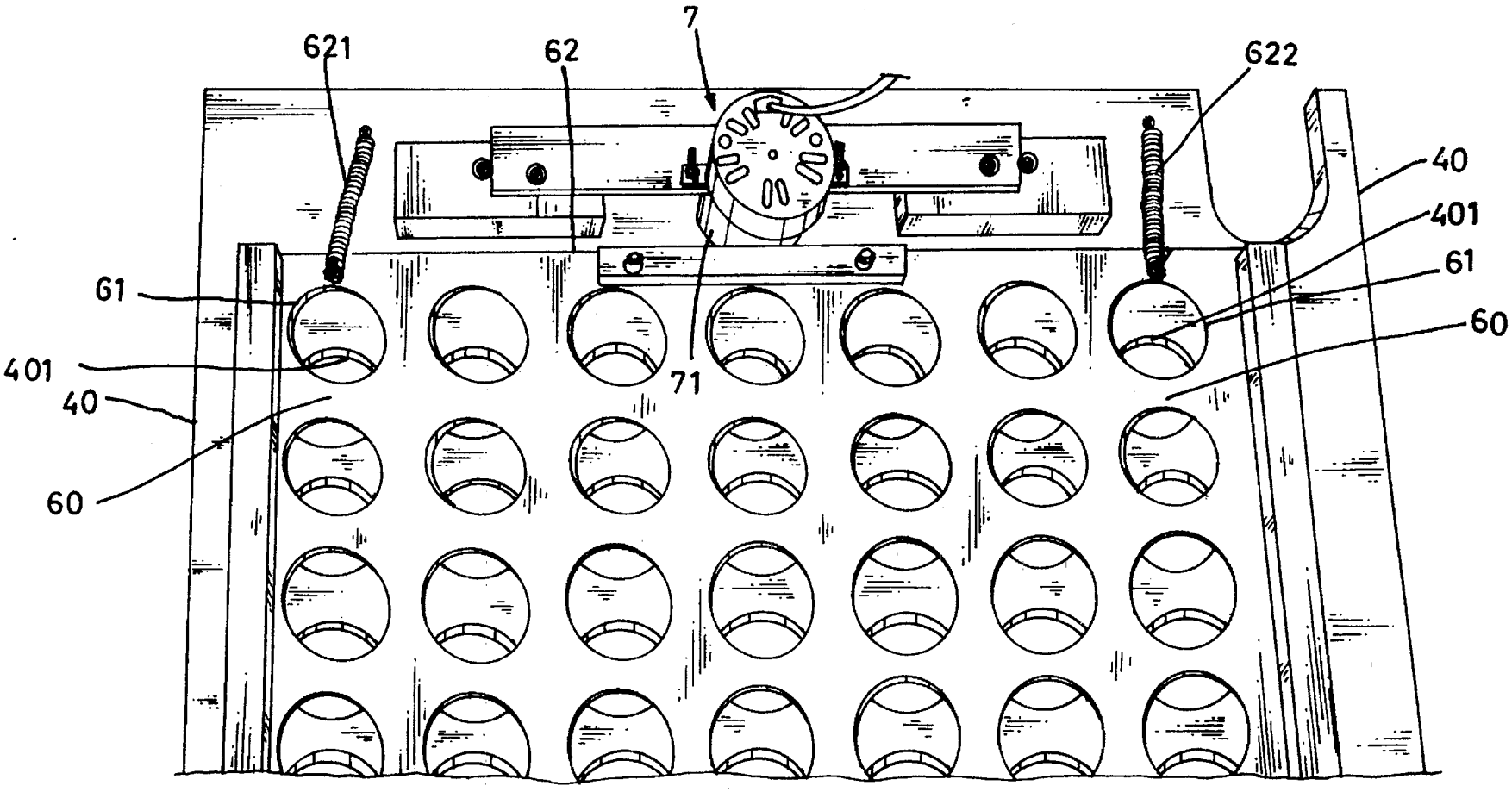
FIG. 5 is similar to FIG. 4 but showing the ball holes of the sliding plate not aligned with the ball holes of the top cover of the ball chamber.

When the blower 2 is turned to blow the balls 10 one ball 10 is forced into the ball inlet 31 and stopped by the valve rod 81 of the electromagnetic valve 8 (see FIG. 3). When the electromagnetic valve 81 is controlled by the control circuit to move the valve rod 81 out of the ball outlet conduit 3, the ball inlet 31 is opened to let the ball 10 pass through the ball outlet conduit 3 and move out of the ball outlet 321 to one ball hole 401 of the top cover 40 of the ball chamber 4. At the same time, the presence of the ball 10 in one ball hole 401 is detected by the respective electric eye, which gives a signal to the control circuit, informing the control circuit the location of the presence of the ball 10. When certain pieces of the balls 10 (for example, five pieces of the balls 10, six pieces of the balls 10, or seven pieces of the balls 10, etc.) have been moved to the ball holes 401 of the top cover 40 of the ball chamber 4, the control circuit automatically counts the payoff rate. After the payoff rate is shown, the motor 7 is started to move the sliding plate 6 relative to the top cover 40 of the ball chamber 4, permitting the ball holes 61 to be respectively aligned with the ball holes 401 of the top cover 40 of the ball chamber 4. When the ball holes 61 of the sliding plate 6 are respectively aligned with the ball holes 401 of the top cover 40 of the ball chamber 4, the balls 10 immediately fall from the ball holes 401 of the top cover 40 of the ball chamber 4 through the ball holes 61 of the sliding plate 6 to the inside of the ball chamber 4.

I claim:

1. A bingo game machine comprising:

a casing having a ball chamber, and a plurality of hollow light balls put in said ball chamber, said ball chamber having rows of ball holes respectively marked with a specific marking for letting said balls pass, and two parallel sliding grooves bilaterally disposed at a bottom side;

a transparent covering covered on the top cover of said ball chamber over the ball holes of said top cover of said ball chamber;

a ball outlet conduit having a ball inlet inserted into said ball chamber, and a ball outlet extended out of the top cover of said ball chamber and disposed in the space defined between the top cover of said ball chamber of said transparent covering;

a blower mounted inside said casing and controlled to blow air into said ball chamber, causing said balls to bounce in said ball chamber and to move through said ball outlet conduit to the ball holes of the top cover of said ball chamber;

a sliding plate reciprocated in the sliding grooves of the top cover of said ball chamber, said sliding plate having rows of ball holes corresponding to the rows of ball holes of the top cover of said ball chamber;

a reciprocating mechanism controlled to reciprocate said sliding plate between a first position in which the ball holes of said sliding plate are respectively aligned with the ball holes of the top cover of said ball chamber for letting the balls pass, and a second position in which the ball holes of said sliding plate are not aligned with the ball holes of the top cover of said ball chamber so that the balls can be stopped in the ball holes of the top cover of said ball chamber;

a plurality of electric eyes respectively mounted between the top cover of said ball chamber and said sliding plate to detect the presence of a ball in each ball hole of the top cover of said ball chamber;

a micro switch mounted on said ball outlet conduit near the ball inlet of said ball outlet conduit for counting the number of balls passing from said ball chamber into said ball outlet conduit;

an electromagnetic valve mounted on said ball outlet conduit and driven to control the passage of the ball inlet of said ball outlet conduit; and a control circuit for controlling the operation of said blower, said reciprocating mechanism, said electric eyes, said micro switch, and said electromagnetic valve.

* * * * *